US005706988A

United States Patent [19]

Moore

[11] Patent Number: 5,706,988

[45] Date of Patent: Jan. 13, 1998

[54] STOCKING AID DEVICE

[76] Inventor: Patrick Augustine Moore, 19 Donscourt, Bishopstown, Cork, Ireland

[21] Appl. No.: 580,234

[22] Filed: Dec. 28, 1995

[30] Foreign Application Priority Data

Dec. 30, 1994 [IL] Israel ..... 8941009

[51] Int. Cl.[6] ..... A47G 25/90

[52] U.S. Cl. ..... 223/111; 223/112

[58] Field of Search ..... 223/111, 112, 223/118, 119

[56] References Cited

U.S. PATENT DOCUMENTS

| | | | |
|---|---|---|---|
| 2,443,115 | 6/1948 | Park | 223/111 |
| 3,396,882 | 8/1968 | Berlin | 223/111 |
| 3,452,907 | 7/1969 | MacLauchlan | 223/111 |
| 3,853,252 | 12/1974 | Scianimanico | 223/111 |
| 3,860,156 | 1/1975 | Lawrence | 223/111 |
| 4,066,194 | 1/1978 | Leland | 223/111 |
| 4,072,255 | 2/1978 | Bogorad | 223/111 |
| 4,238,061 | 12/1980 | Marchetti et al. | 223/111 |
| 4,260,083 | 4/1981 | Aslin | 223/111 |
| 4,284,216 | 8/1981 | Leland | 223/111 |
| 4,637,532 | 1/1987 | Doorenbos | 223/111 |
| 4,651,909 | 3/1987 | Banting | 223/111 |
| 4,756,453 | 7/1988 | Pettit et al. | 223/111 |
| 4,789,087 | 12/1988 | Doorenbos | 223/111 |
| 4,858,795 | 8/1989 | Selinko | 223/111 |
| 4,991,757 | 2/1991 | Deakyne | 223/112 |
| 5,050,783 | 9/1991 | Hunter | 223/112 |
| 5,249,720 | 10/1993 | White | 223/112 |
| 5,322,199 | 6/1994 | White | 223/112 |

*Primary Examiner*—Bibhu Mohanty
*Attorney, Agent, or Firm*—Sheridan Ross P.C.

[57] ABSTRACT

A stocking aid device (1) comprises a pair of rigid handles (6) for ease of manipulation and a U-shaped member which is connected pivotally to the rods about a generally transverse axis with a sufficient degree of freedom to allow the U-shaped member to pivot freely about the axis and slide over the user's heel and up the back of the leg when applying the stocking. The U-shaped member thus follows a curving path under the sole of the foot around the heel and up the back of the leg whilst applying the stocking. This is facilitated by a slight twisting of the rods which provide handles, so as to impede rotation of the U-shaped member. One edge is flared outwardly to form a flange (2) comprising a series of indentations (3). The indentations are pointed, but are not sharp, such that a sock or stocking is placed into the concave side of the U-shaped member (1) and part of the elasticated rim of the stocking is hooked over the indentations (3) so as to grip the stocking prior to applying a stocking with the device.

3 Claims, 1 Drawing Sheet

STOCKING AID DEVICE

The present invention relates to a stocking aid device for assisting a person to apply stockings, socks or other hosiery to the feet when there is a difficulty in bending down.

BACKGROUND OF THE INVENTION

Many people find it difficult to bend down to apply socks and stockings including the elderly, obese, persons with a physical disability or sufferers of arthritis, and pregnant women in their final trimester. Many devices have been proposed which are manipulated by hand so as to attach to an elasticated edge of a sock or stocking, usually including an elongated handle or cord with which to pull the sock or stocking over the foot, without the necessity of bending down, wherein the device is easily released from the sock or stocking by pulling away from or pushing towards the foot. However, many of these devices require a considerable amount of dexterity to attach the sock or stocking, to pull the sock or stocking over the foot without it detaching from the device prematurely, and finally to detach the device properly from the sock or stocking once this has been pulled up sufficiently.

Some of these devices comprise a wire frame with suitable bends to allow the device to catch the edge of a stocking and also allow for a handle, such as disclosed in U.S. Pat. No. 4,284,216 and U.S. Pat. No. 4,858,795. Another type of stocking aid comprises a tongue of flexible sheet material which can be folded so as to fit inside a stocking, with lips to catch the elasticated edge and a string or cord to pull the tongue and stocking over the foot, such as disclosed in U.S. Pat. No. 4,651,909 and U.S. Pat. No. 4,637,532. A combination of these two is disclosed in U.S. Pat. No. 4,260,083. Devices for donning stockings without bending the knees have also been proposed in which in addition to a tongue member, side straps are also provided with releasable clasps for attaching to the opening of the stocking, for example as disclosed in U.S. Pat. No. 3,452,907. These are particularly difficult to manipulate, but do overcome the problem of the sock becoming detached prematurely, but of course do require that the strap be pulled in a manner which allows the clasp to disengage.

Other devices have been proposed with rigid rods or handles such as disclosed in U.S. Pat. No. 5,050,783. These normally terminate in a U-shaped or short channel-shaped member which fits inside and stretches the elasticated edge of the stocking and can be released on pulling the rod(s) away from the foot. U.S. Pat. No. 4,756,453 discloses a device of this type with a pair of telescopic rods which are hinged together to provide a scissors action to grip the elasticated edge of the stocking. However, this does not provide a smooth action when pulling the sock around the heel and requires the user to spread the rods apart throughout this action so as to maintain the stocking in place. U.S. Pat. No. 5,050,783 mentioned above comprises a single rod which is not hingedly connected to the U-shaped member, and is consequently awkward to manipulate over the user's heel.

The present invention seeks to overcome these difficulties by providing a stocking aid device with a pair of rigid handles for ease of manipulation and a U-shaped member which is connected pivotally or hingedly to the rods about a generally transverse axis with a sufficient degree of freedom to allow the U-shaped member to pivot freely about the axis and slide over the user's heel and up the back of the leg when applying the stocking. The U-shaped member thus follows a curving path under the sole of the foot around the heel and up the back of the leg whilst applying the stocking without the need to manipulate the rods which provide handles. However the handles may be manipulated if desired by twisting them slightly in opposite directions, one clockwise, one counterclockwise, to prevent or impede pivotal movement of the U-shaped member about the transverse axis as the stocking is being applied. This allows the user to control the movement of the U-shaped member relative to the rigid handles whilst pulling the attached stocking over the foot.

Accordingly, the present invention provides a device for aiding in putting on a stocking comprising

- a U-shaped member defining a smooth surfaced concavity with one edge being adapted to grip an outer elasticated edge of the stocking when stretched across said edge, the two sides of said member defining opposing limbs,
- pivot means extending outwardly from each of said limbs of the U-shaped member and defining a generally transverse axis,
- a pair of elongated substantially rigid handle members, each member being articulated with respect to said pivot means to allow rotation of said U-shaped member about said transverse axis, but having a sufficient degree of freedom so as to allow each handle member to be twisted about said pivot means to impede rotational movement about said transverse axis.

Preferably, the edge adapted to grip an outer elasticated edge of the stocking comprises an outwardly-turned flange. The flange preferably defines a series of indentations with points adapted to grip, but not to tear, the elasticated edge of a stocking.

Advantageously, the pivots which extend outwardly from the U-shaped member lie in a straight line. Alternatively, the pivots defining the transverse are offset at a slight angle, such that on twisting and splaying the handle members, the U-shaped member can be caused to flip over on itself or rotate and swing through an angle of 360°.

DETAILED DESCRIPTION OF THE INVENTION

Figure 1:
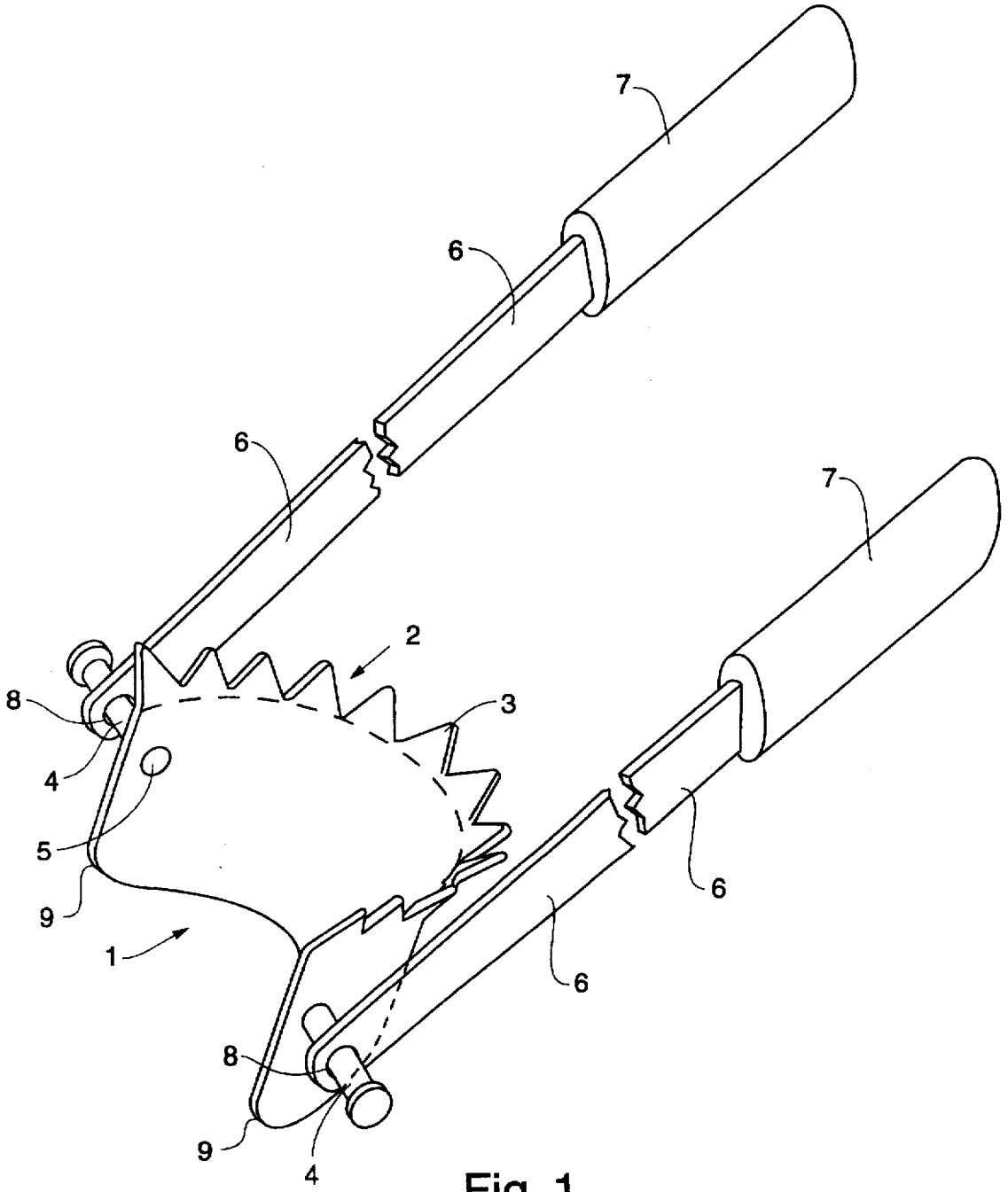
FIG. 1 is a perspective view of a stocking aid device in accordance with the invention, in which the elongated handle members have been broken, for clarity.

A stocking aid device according to the invention comprises a U-shaped member 1 which may be made from a channel section of plastic material, in which one edge is flared outwardly to form a flange 2 comprising a series of indentations 3. The indentations are pointed, but are not sharp, such that when a sock or stocking is placed into the concave side of the U-shaped member 1, a part of the elasticated rim of the stocking may be hooked over the indentations 3 so as to grip the stocking prior to applying a stocking with the device. A pair of pivots 4 extend transversely from the outer convex side of the side limbs of the U-shaped member, but it is important that the junction of the pivots 4 on the inside or concave surface of the U-shaped member 1 is smooth, as at 5, thereby allowing the stocking to slip off the U-shaped member without catching when releasing the stocking.

A pair of rods 6 including hand grips 7 is hingedly connected to the pivots 4, but it will be noted that an eye 8 defined at the end of the rods 6, through which the respective pivot 4 passes, is sufficiently large to allow a degree of freedom in the hinged connection. This allows the rods to move in and out along the pivots 4, so as to clear the indentations 3. It also allows a slight twisting motion of the rods with respect to the pivots 4, such that the degree of rotation of the U-shaped member with respect to the rods can be controlled if desired by twisting the hand-grips 7, for example, by twisting one clockwise and the other counterclockwise, i.e. causing the eyes 8 to cam against the pivots 4, thereby allowing the user to pull the U-shaped member with a stocking attached, over the sole of the foot around the heel and up the back of the leg by letting the U-shaped member follow the curves of the body with a minimum of manipulation. There is no need for the user to bend at the waist as the rods 6 are sufficiently long to allow the stocking to be pulled over the foot without bending down. If desired, the rods 6 may be made telescopic, although this is not essential.

To release the device from the stocking it is pulled gently away from the foot at the end of the process, wherein the indentations 3 become detached from the elasticated edge of the stocking, and the U-shaped member is then slid away from the leg without catching the stocking. The edges 9 of the U-shaped member should be rounded so as to avoid catching when releasing the device.

If desired the rods 6 and/or the hand grips 7 may be shaped to facilitate manual gripping of the device e.g. by curving the outer ends of the rods 6 and the hand grips 7 thereon.

I claim:

1. A device for aiding in putting on a stocking comprising:

a U-shaped member defining a smooth interior surfaced concavity with one edge having an outwardly turned flange with indentions to grip an outer elasticated edge of the stocking when stretched across said edge, the two sides of said member defining opposing limbs;

pivot means comprising a pair of transverse pivots each of which extends outwardly from a respective limb of said U-shaped member and defining a generally transverse axis; and a pair of elongated substantially rigid handle members, each member being articulated with respect to said pivot means to allow rotation of said U-shaped member about said transverse axis, but having a sufficient degree of freedom so as to allow each handle member to be twisted about said pivot means and to be moved transversely along said pivot means to impede rotational movement about said transverse axis.

2. A device according to claim 1, wherein said pivots lie in a straight line.

3. A device according to claim 1, wherein said pivots are offset at a slight angle to said generally transverse axis, such that on twisting and splaying the handle members, the U-shaped member can be caused to rotate and swing through an angle of 360°.

* * * * *